US005200732A

United States Patent [19]

Buckshaw et al.

[11] Patent Number: 5,200,732

[45] **Date of Patent: * Apr. 6, 1993**

[54] TEMPERATURE OPERATED SWITCH CONSTRUCTION, TERMINAL BLOCK THEREFOR AND METHODS OF MAKING THE SAME

[75] Inventors: Thomas M. Buckshaw, Indiana; Joseph J. Erdelsky, Jeannette, both of Pa.

[73] Assignee: Robertshaw Controls Company, Richmond, Va.

[ * ] Notice: The portion of the term of this patent subsequent to Sep. 15, 2009 has been disclaimed.

[21] Appl. No.: 878,672

[22] Filed: May 5, 1992

Related U.S. Application Data

[62] Division of Ser. No. 688,157, Apr. 19, 1991, Pat. No. 5,148,142.

[51] Int. Cl.[5] ..... H01H 37/36; H01H 87/00

[52] U.S. Cl. ..... 337/329; 337/122; 335/205

[58] Field of Search ..... 337/329, 330, 331, 332, 337/373, 413, 137, 122, 302, 303, 304; 335/206, 205, 207

[56] References Cited

U.S. PATENT DOCUMENTS 4,054,245 10/1977 Bennetsen et al. ..... 337/303
4,246,457 1/1981 Teichert et al. ..... 200/303

*Primary Examiner*—Harold Broome
*Attorney, Agent, or Firm*—Candor, Candor & Tassone

[57] ABSTRACT

A temperature operated switch construction, terminal block therefor and methods of making the same are provided, the switch construction comprising a housing, a movable switch arm carried in the housing, a temperature actuated unit disposed in the housing and being operatively interconnected to the switch arm to cause movement of the arm between operating positions thereof in relation to the temperature being sensed by the temperature actuated unit, the housing comprising a main part and a removable terminal block carried by the main part, the terminal block carrying a switch unit that is operatively associated with the switch arm so that the switch unit is in a first condition thereof when the switch arm is in a first operating position thereof and the switch unit is in a second condition thereof when the switch arm is in a second operating position thereof, the switch unit comprising a reed switch and the switch arm carrying a magnet for operating the reed switch to the conditions thereof as the switch arm is moved to the positions thereof.

18 Claims, 3 Drawing Sheets

TEMPERATURE OPERATED SWITCH CONSTRUCTION, TERMINAL BLOCK THEREFOR AND METHODS OF MAKING THE SAME

CROSS REFERENCE TO RELATED APPLICATION

This application is a divisional patent application of its copending parent patent application Ser. No. 688,157, filed Apr. 19, 1991, now U.S. Pat. No. 5,148,142.

BACKGROUND OF THE INVENTION

1. Field of the Invention

This invention relates to a new temperature operated switch construction and to a new terminal block for such a switch construction as well as to new methods of making such a temperature operated switch construction and such a terminal block.

2. Prior Art Statement

It is known to provide a temperature operated switch construction comprising a housing means, a movable switch arm carried in the housing means, temperature actuated means disposed in the housing means and being operatively interconnected to the switch arm to cause movement of the switch arm between operating positions thereof in relation to the temperature being sensed by the temperature actuated means, the housing means comprising a main part and a removable terminal block carried by the main part, the terminal block carrying a switch means that is operatively associated with the switch arm so that the switch means is in a first condition thereof when the switch arm is in a first operating position thereof and the switch means is in a second condition thereof when the switch arm is in a second operating position thereof. For example, see FIGS. 1 and 2 of this application.

It is also known to operate a reed switch means through the movement of a switch arm that carries a magnet means. For example, see FIGS. 4 and 5 of this application.

It is also known to move such switch arm for influencing the operating condition of a reed switch means by temperature actuated means. For example, see the U.S. Pat. No. to Teichert et al, No. 4,246,457.

SUMMARY OF THE INVENTION

It is a feature of this invention to provide a new temperature operated switch construction wherein a reed switch means is utilized therein in a unique manner.

In particular, it has been found according to the teachings of this invention that a certain temperature operated switch construction or thermostat that normally has a switch arm moved by temperature actuated means so as to place contact means of that switch arm into electrical contact with or out of electrical contact from contact means carried by a terminal block of the switch construction is subject to the adverse effects of abnormal environments, such as elevated temperatures, light electrical loads and the presence of cooking oil vapors and greases.

Therefore, it was also found according to the teachings of this invention that the basic structure of such a temperature operated switch construction can be utilized with a hermetically sealed reed switch by replacing the contact means on the switch arm with a permanent magnet means and providing a special terminal block to replace the terminal block of the temperature operated switch construction, such new terminal block having the reed switch mounted therein so that the reed switch contacts make and break as the magnet means changes position relative to the location of the reed switch.

For example, one embodiment of this invention comprises a temperature operated switch construction comprising a housing means, a movable switch arm carried in the housing means, temperature actuated means disposed in the housing means and being operatively interconnected to the switch arm to cause movement of the arm between operating positions thereof in relation to the temperature being sensed by the temperature actuated means, the housing means comprising a main part and a removable terminal block carried by the main part, the terminal block carrying a switch means that is operatively associated with the switch arm so that the switch means is in a first condition thereof when the switch arm is in a first operating position thereof and the switch means is in a second condition thereof when the switch arm is in a second operating position thereof, the switch means comprising a reed switch means and the switch arm carrying a magnet means for operating the reed switch means to the conditions thereof as the switch arm is moved to the positions thereof.

Accordingly, it is an object of this invention to provide a new temperature operated switch construction having one or more of the novel features of this invention as set forth above or hereinafter shown or described.

Another object of this invention is to provide a new method of making such a temperature operated switch construction, the method of this invention having one or more of the novel features of this invention as set forth above or hereinafter shown or described.

Another object of this invention is to provide a new terminal block for such a temperature operated switch construction, the terminal block of this invention having one or more of the novel features of this invention as set forth above or hereinafter shown or described.

Another object of this invention is to provide a new method of making such a terminal block, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
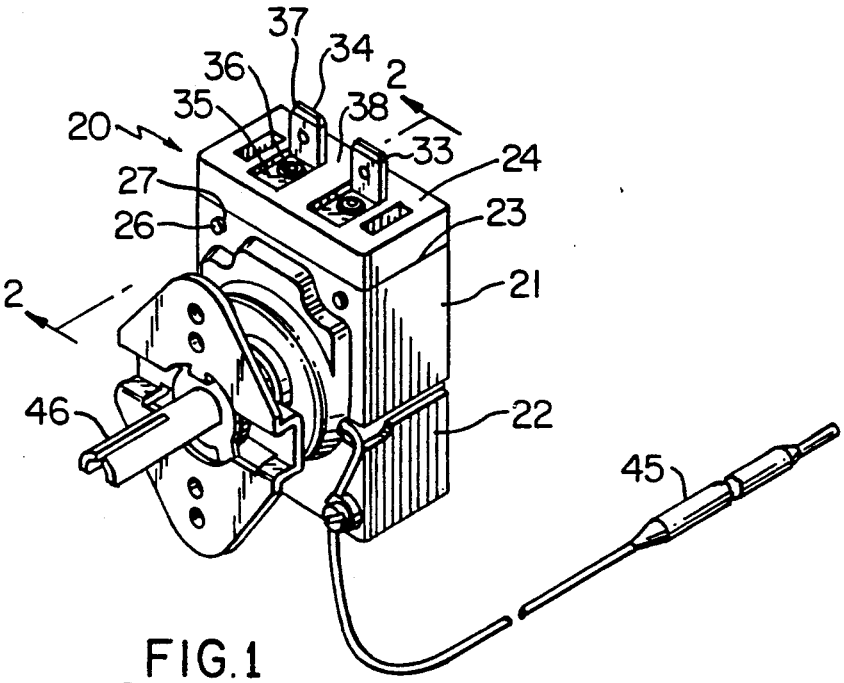
FIG.1 PRIOR ART
FIG. 1 is a front perspective view of a prior known temperature operated switch construction.

While the various features of this invention are hereinafter illustrated and described as being particularly adapted to provide a temperature operated switch construction of a certain configuration, it is to be understood that the various features of this invention can be utilized singly or in various combinations thereof to provide structure for other types of temperature operated switch constructions, as desired.

Therefore, this invention is not to be limited to only the embodiments thereof that are illustrated in the drawings, because the drawings are merely utilized to illustrate one of the wide variety of uses of this invention.

Figure 2:
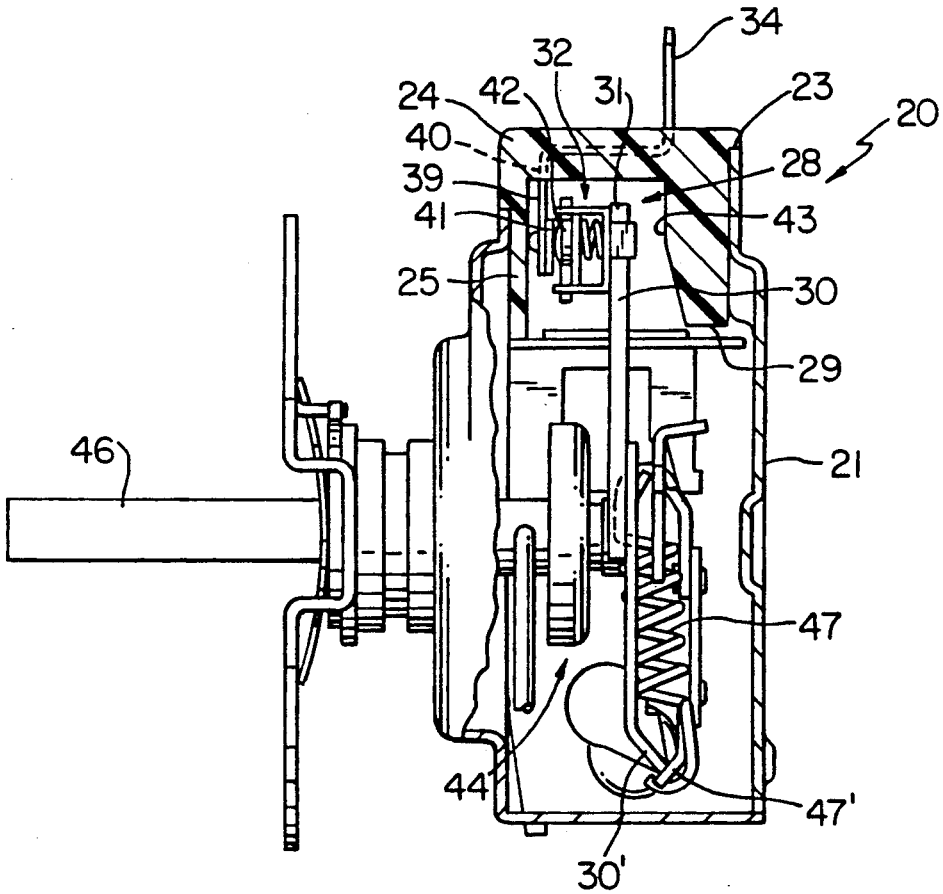
FIG.2 PRIOR ART
FIG. 2 is an enlarged fragmentary cross-sectional view taken on line 2—2 of FIG. 1.

Referring now to FIGS. 1 and 2, a prior known temperature operated switch construction is generally indicated by the reference numeral 20 and comprises a housing means 21 formed of a metallic casing or part 22 having an open end 23 in which a terminal block 24 has a portion 25 thereof disposed therein and being secured thereto by threaded fastening members 26 passing through suitable openings 27 in the casing 22 and aligned openings (not shown) in the terminal block 24 to hold the terminal block 24 in its assembled relation as illustrated in FIGS. 1 and 2 in a manner well known in the art.

The terminal block 24 is formed of electrically insulating material, such as polymeric material, and has a cavity 28 therein that interrupts a lower surface means 29 thereof so that a movable arm 30 can have an end 31 thereof project into the cavity 28 and be movable therein as will be apparent hereinafter, the movable arm 30 operating an electrical switch means that is generally indicated by the reference numeral 32 in FIG. 2 and is carried by the terminal block 24.

In particular, the switch means 32 comprises two like conductive terminals 33 and 34 each having an intermediate portion 35 secured to the terminal block 24 by a fastening means 36 so that an upstanding portion 37 thereof projects upwardly from a top surface 38 of the terminal block 24 and another portion 39 thereof extends through an opening 40 in the terminal block 24 to project into the cavity 28 and carry a contact 41 thereon.

The end 31 of the switch arm 30 carries a contact bar means 42 that is adapted to engage against the contacts 41 of the terminals 33 and 34 so as to conductively bridge or electrically interconnect the same together when the arm 30 is in its left-hand position as illustrated in FIG. 2. However, when the arm 30 is moved to the right so as to engage against a stop surface 43 of the terminal block 24, the bridging contact member 42 is held out of contact with the contacts 41 of the terminals 33 and 34 so as to prevent electrical connection therebetween.

In this manner, the terminals 33 and 34 can be interconnected by suitable external leads (not shown) to any desired means, such as a load means, to be operated only when the switch arm 30 is holding the contact bar means 42 in electrical contact with the contacts 41.

The switch blade 30 is moved between its operating positions by a temperature actuated means that is generally indicated by the reference numeral 44 in FIG. 2 and has a temperature sensing bulb 45 and a selector shaft 46, all parts that are well known in the art whereby the setting of the selector shaft 46 determines the temperature that the temperature sensing bulb 45 senses to cause the switch blade 30 to be disposed in the contact closing condition of FIG. 2 and what temperature the temperature sensing bulb 45 senses to move the switch arm 30 out of the contact closing position thereof all in a manner well known in the art.

For example, while the switch blade 30 of the temperature operated switch construction 20 is adapted to be snapped between its operating positions by spring means 47 and having its lower end 30' pivotally mounted to lever structure 47', it is to be understood that any suitable temperature actuated means can be utilized to move the switch blade 30 to its pivoted left-hand position as illustrated in FIG. 2 and to its right-hand pivoted position wherein the same is engaging against the stop means 43 as desired.

Such a temperature operated switch construction or thermostat 20 is a part well known in the art and can be purchased as a K thermostat from the Robertshaw Controls Company of Richmond, Va.

However, as previously stated, it is a feature of this invention to replace the switch means 32 of the temperature operated switch construction 20 with a reed switch means that is uniquely carried by a terminal block assembly that is adapted to replace the terminal block 24 of the switch construction 20 so as to form a new temperature operated switch construction that still utilizes a major portion of the previously designed parts.

Figure 3:
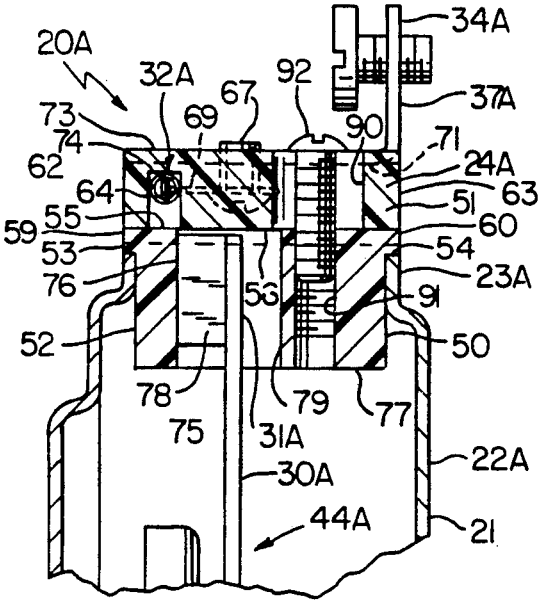
FIG. 3 is a fragmentary view similar to FIG. 2 and illustrates the new temperature operated switch construction of this invention.

In particular, reference is now made to FIG. 3 wherein the new temperature operated switch construction of this invention is generally indicated by the reference numeral 20A and parts thereof similar to the switch construction 20 previously described are indicated by like reference numerals followed by the reference letter "A".

As illustrated in FIG. 3, the temperature operated switch construction 20A of this invention includes the housing means 21A, the temperature actuated means 44A and the switch arm 30A, the housing means 21A comprising the casing 22A previously described and having the open end 23A thereof closed by a new terminal block means 24A of this invention and that carries a switch means 32A in a manner hereinafter set forth.

The terminal block 24A of this invention is formed of electrically insulating material, such as polymeric material, and is formed of two parts 50 and 51 adjustably secured together in a manner hereinafter set forth, the part 50 having a lower substantially rectangular section 52 that fits into the open end 23A of the casing 22A and has an outwardly directed rectangular flange 53 that will rest against the top surface 54 of the casing 22A when the section 52 is fully inserted therein in the manner illustrated in FIG. 3 whereby a substantially flat surface 55 on the part 50 faces outwardly from the casing 22A.

The part 51 of the terminal block 24A is also substantially rectangular in configuration and has a substantially flat surface 56 that is adapted to be disposed against the flat surface 55 of the part 50, the surfaces 55 and 56 being adapted to permit sliding movement therebetween except that the surfaces 55 and 56 respectively have spline means 57 limiting such sliding movement in one axial direction relative to each other.

For example, the spline means 57 comprises an upstanding projection or flat rib 58 on the surface 55 of the part 50 that extends from one end 59 to the other end 60 of the flange 53 thereof while the surface 56 has a cooperating slot or groove 61 formed therein and extending from one side 62 to the other side 63 thereof as illustrated. Of course, the spline means 57 could be a dovetailed arrangement if desired and/or could comprise more than one cooperating rib means and groove means if desired.

The surface 56 of the part 51 of the terminal block 24A is interrupted by a recess 64 that has an intermediate portion 65 in which the switch means 32A is disposed and has end portions 66 wherein threaded fastening members 67 and 68 are disposed and are adapted to respectively electrically interconnect leads 69 and 70 of the switch means 32A respectively to legs 71 of the terminals 33A and 34A which are held in suitable grooves 72 in the top surface 73 of the part 51 as illustrated in any suitable manner, such as by the same fastening means 67 and 68 as illustrated. In this manner, the upstanding parts 37A of the terminals 33A and 34A can be respectively interconnected to an external load means as desired and as previously described.

Figure 6:
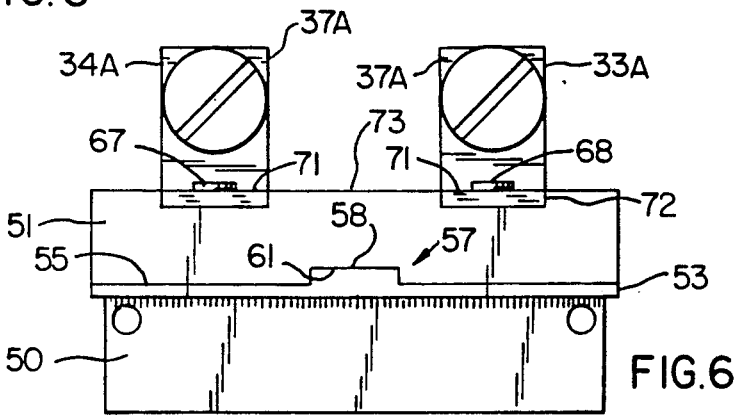
FIG. 6 is a front view of the terminal block of this invention that is utilized in the temperature operated switch construction of FIG. 3.
Figure 7:
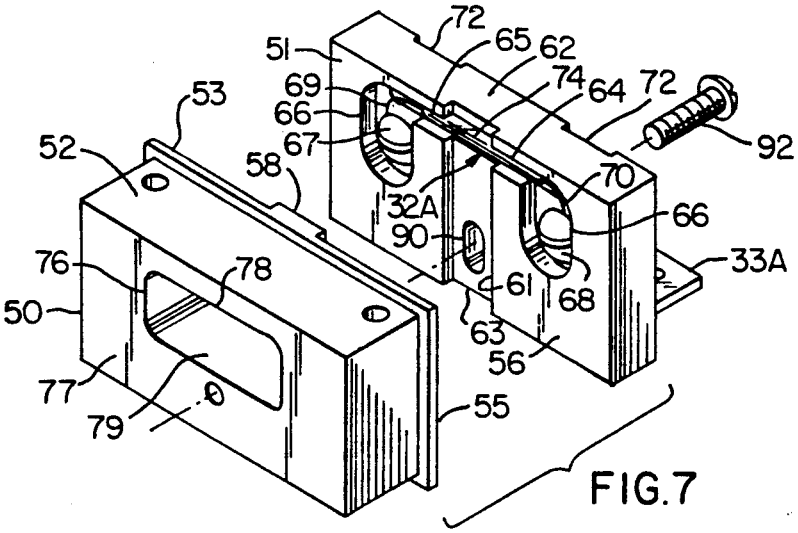
FIG. 7 is an exploded perspective view of the two parts of the housing block construction of FIG. 6.

The switch means 32A of this invention comprises a hermetically sealed reed switch 74 that can be of the normally open or the normally closed type and is adapted to be influenced by the magnetic field of a permanent magnet 75 that is carried on the end 31A of the switch blade 30A as illustrated in FIG. 6.

In particular, the part 50 of the terminal block 24A has an opening 76 passing through the opposed surfaces 55 and 77 thereof, the opening 76 being substantially oblong and rectangular in configuration so as to define opposed facing substantially parallel stop surfaces 78 and 79 as illustrated in FIG. 3 whereby the end 31 of the switch blade 30A is adapted to project into the opening 76 and be moved therein from its left-hand position as illustrated in FIG. 3 wherein the magnet 75 is engaged against the stop surface 78 and to the right until the switch blade 30A engages against the stop surface 79 so that such movement of the magnet means 75 influences the operating condition of the reed switch 74 in a manner well known in the art.

Figure 4:
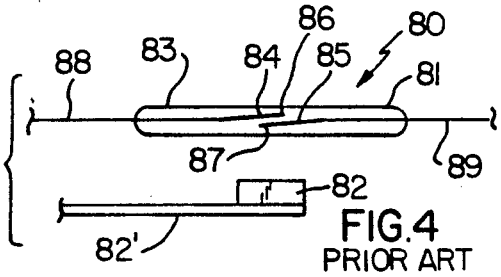
FIG.4 PRIOR ART
FIG. 4 is a schematic view illustrating a prior known reed switch means, FIG. 4 illustrating the reed switch in an open condition thereof.
Figure 5:
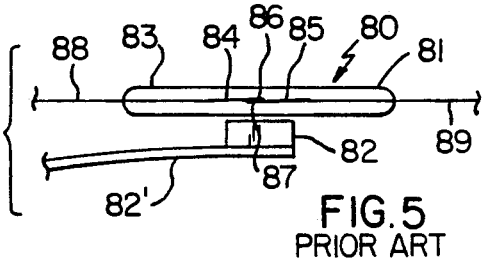
FIG.5 PRIOR ART
FIG. 5 is a view similar to FIG. 4 and illustrates the reed switch means in a closed condition thereof.

For example, reference is now made to FIGS. 4 and 5 wherein a prior known reed switch means is generally indicated by the reference numeral 80 and comprises a reed switch 81 and a movable magnet means 82, the reed switch 81 having a hermetically sealed glass envelope 83 containing two switch blades 84 and 85 therein that normally have the respective ends 86 and 87 thereof disposed spaced apart from each other through the natural resiliency of the blades 84 and 85 whereby electrical current cannot flow through the reed switch 81 from an external lead 88 of the switch blade 84 to an external lead 89 of the switch blade 85. However, when the permanent magnet 82 is moved toward the reed switch 81 in the manner illustrated in FIG. 5, such as by movement of a switch blade 82' carrying the permanent magnet 82, the magnetic field of the magnet 82 causes the ends 86 and 87 of the switch blades 84 and 85 to move together in the manner illustrated in FIG. 5 and thereby close the switch 81 so that electrical current can flow between the external leads 88 and 89 through the switch means 81 all in a manner well known in the art.

Thus, when the switch blade 82' moves the permanent magnet 82 away from the switch 81 a certain distance, the reduced magnetic field being imposed on the ends 86 and 87 of the switch blades 84 and 85 is insufficient to overcome the natural resiliency of the blades 84 and 85 so that the ends 86 and 87 can again move apart in the manner illustrated in FIG. 4 and thereby prevent electrical connection between the leads 88 and 89.

Of course, as previously stated the reed switch 81 can be of the type that is normally closed so that the movement of the magnet 82 toward the reed switch 81 opens the contacts rather than close the same as is well known in the art.

In any event, it can be seen that the reed switch 74 of the terminal block 24A of this invention will be in one condition thereof when the magnet 75 is disposed against the stop wall 78 of the part 50 of the terminal block 24A and the switch 74 will be in the other operating condition thereof when the blade 30A is against the stop wall 79, such movement of the switch blade 30A being under the control of the temperature actuated means 44A sensing certain temperature conditions as previously set forth.

However, in order to provide means for adjusting the location of the switch 74 relative to the magnet 75, the part 50 can slide relative to the part 51 so that the position of the switch 74 relative to the magnet 75 when the magnet 75 is against the stop surface 78 can be adjusted.

In particular, an elongated opening 90 is formed through the part 51 and is aligned with a threaded opening 91 in the part 50 so that a threaded fastening member 92 can pass through the slot or elongated opening 90 and be received in the threaded opening 91 of the part 50 to securely fasten the parts 51 and 50 together in the adjusted position of the part 51 on the part 50 for the reasons previously set forth.

In this manner, it will be assured that the magnet 75 will change the operating condition of the switch 74 when the magnet 75 is moved against the stop surface 78.

Therefore, it can be seen that it is a relatively simple method of this invention to convert the switch construction 20 of FIGS. 1 and 2 to utilize the terminal block 24A of this invention as well as the permanent magnet 75 and thereby permit the resulting switch construction 20A of this invention to be utilized in abnormal environments such as provided by the presence of cooking oil vapors and greases so that the internal workings of the switch 74 will not be affected by such adverse environments as would be the case with the contacts 41 and 42 of the switch means 32 previously described.

For example, the contact means 42 of the switch blade 30 of FIG. 2 can be removed and the permanent magnet 75 can be secured on the end 31 of the switch arm 30 to produce the switch arm 30A as illustrated in FIG. 3 and the terminal block 24 can be removed to be placed by the new terminal block 24A by utilizing the same fastening means 27 of FIG. 1 to secure the terminal block 24A in place whereby the resulting new switch construction 20A of this invention will operate in a manner now to be described.

When the temperature being sensed by the temperature actuated means 44A is at a certain temperature that has been previously selected by the selector shaft (not shown but similar to the selector shaft 46 previously described) the temperature actuated means 44A moves and holds the switch blade 30A against the stop means 78 in the manner illustrated in FIG. 3 so that the magnet 75 causes the switch means 32A to be in a certain operating condition thereof, such as electrically interconnecting the terminals 33A and 34A together whereas when the temperature being sensed by the temperature actuated means 44A is at another temperature, the temperature actuated means 44A moves the switch blade 30A and holds the same against the stop means 79 so that the magnet 75 now permits the switch means 32A to be in the other condition thereof, such as electrically disconnecting the terminals 33A and 34A from each other.

In this manner, it can be seen that the switch construction 20A is a single pole single throw arrangement that can have the contacts of the reed switch 74 open on temperature rise. However, by changing the location of the reed switch 74 relative to the magnet 75, such as being adjacent the stop surface 79, it can be seen that the result would produce a single pole single throw that would close on temperature rise.

Similarly, a double pole single throw arrangement could be provided by utilizing two reed switches in the terminal block of this invention.

Figure 8:
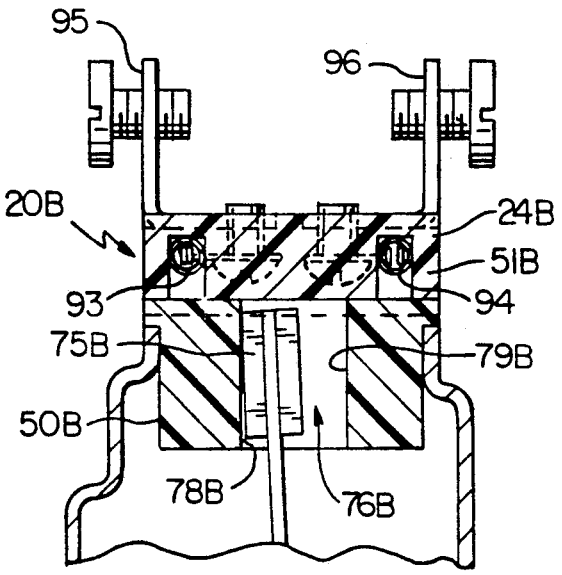
FIG. 8 is a view similar to FIG. 3 and illustrates another temperature operated switch construction of this invention.
Figure 9:
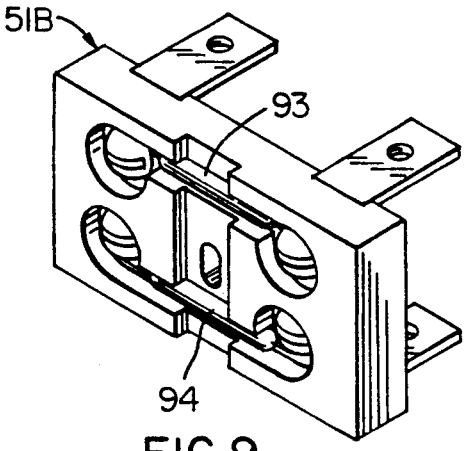
FIG. 9 is a perspective view of one of the parts of the terminal block of the switch construction of FIG. 8.

In particular, reference is now made to FIGS. 8 and 9 wherein another temperature operated switch construction of this invention is generally indicated by the reference numeral 20B and parts thereof similar to the switch construction 20A previously described are indicated by like reference numerals followed by the reference letter "B".

As illustrated in FIGS. 8 and 9, the part 51B of the terminal block 24B carries two reed switches 93 and 94 so located relative to the opening 76B in the part 50B of the terminal block 24A, that the switch 93 will be in a closed condition when the magnet 75B is against the stop 78B and the switch 94 will be in an open condition whereas when the magnet 75B is moved against the stop 79B, the switch 93 will be in an open condition and the switch 94 will be in a closed condition.

In this manner, the switch 93 would control the terminal means 95 and the switch means 94 would control the terminal means 96 in a double pole single throw manner.

Thus, it can be seen that many arrangements can be provided by the unique terminal block and permanent magnet means of this invention and by providing the terminal block in two parts so that one part can be adjusted relative to the other part, fine tuning of the arrangement can be provided so that the magnet will properly operate the reed switch means in the desired manner.

Therefore, not only does this invention provide a new temperature operated switch construction and a new terminal block therefor, but also this invention provides a new method of making a temperature operated switch construction and a new method of making a terminal block therefor.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a temperature operated switch construction comprising a housing means, a movable switch arm carried in said housing means, temperature actuated means disposed in said housing means and being operatively interconnected to said switch arm to cause movement of said arm between operating positions thereof in relation to the temperature being sensed by said temperature actuated means, said housing means comprising a main part and a removable terminal block carried by said main part, said terminal block carrying a switch means that is operatively associated with said switch arm so that said switch means is in a first condition thereof when said switch arm is in a first operating position thereof and said switch means is in a second condition thereof when said switch arm is in a second operating position thereof, the improvement wherein said switch means comprises a reed switch means and wherein said switch arm carries a magnet means for operating said reed switch means to said conditions thereof as said switch arm is moved to said positions thereof, said terminal block having spaced apart stop means that are respectively engaged by said switch arm and thereby determine said positions thereof.

2. A switch construction as set forth in claim 1 wherein said reed switch means comprises a single reed switch.

3. A switch construction as set forth in claim 1 wherein said reed switch means comprises a plurality of separate reed switches.

4. A switch construction as set forth in claim 1 wherein said terminal block has an opening therein that defines two facing and spaced apart surface means, said two surface means comprising said stop means, said reed switch means having a longitudinal axis and being carried by said terminal block so that said axis thereof is generally parallel to said surface means.

5. A switch construction as set forth in claim 1 wherein said terminal block comprises two parts adjustably secured together whereby the position of one of said parts can be adjusted relative to the other of said parts.

6. A switch construction as set forth in claim 5 wherein said reed switch means is carried by one of said parts of said terminal blocks.

7. A switch construction as set forth in claim 6 wherein the other of said parts of said terminal block has said stop means.

8. A switch construction as set forth in claim 7 wherein said other of said parts of said terminal block has an opening therethrough that defines two facing and spaced apart surface means, said two surface means comprising said stop means, said reed switch means having a longitudinal axis and being carried by said one of said parts of said terminal block so that said axis thereof is generally parallel to said surface means.

9. A switch construction as set forth in claim 5 wherein said two parts of said terminal block respectively have facing surfaces disposed in sliding relation and having spline means splining said surfaces together so as to limit the sliding movement therebetween.

10. In a removable terminal block for a temperature operated switch construction comprising a housing means, a movable switch arm carried in said housing means, and temperature actuated means disposed in said housing means and being operatively interconnected to said switch arm to cause movement of said arm between operating positions thereof in relation to the temperature being sensed by said temperature actuated means, said housing means comprising a main part and said removable terminal block that is to be carried by said main part, said terminal block carrying a switch means that is adapted to be operatively associated with said switch arm so that said switch means is adapted to be in a first condition thereof when said switch arm is in a first operating position thereof and said switch means is adapted to be in a second condition thereof when said switch arm is in a second operating position thereof, the improvement wherein said switch means comprises a reed switch means that is adapted to be operated to said conditions thereof by a magnet means carried by said switch arm and being moved to said positions thereof, said terminal block having spaced apart stop means that are adapted to be respectively engaged by said switch arm and thereby determine said positions thereof.

11. A terminal block as set forth in claim 10 wherein said reed switch means comprises a single reed switch.

12. A terminal bock as set forth in claim 10 wherein said reed switch means comprises a plurality of separate reed switches.

13. A terminal block as set forth in claim 10 wherein said terminal block has an opening therein that defines two facing and spaced apart surface means, said two surface means comprising said stop means, said reed switch means having a longitudinal axis and being carried by said terminal block so that said axis thereof is generally parallel to said surface means.

14. A terminal block as set forth in claim 10 wherein said terminal block comprises two parts adjustably secured together whereby the position of one of said parts can be adjusted relative to the other of said parts.

15. A terminal block as set forth in claim 14 wherein said reed switch means is carried by one of said parts of said terminal block.

16. A terminal block as set forth in claim 15 wherein the other of said parts of said terminal block has said stop means.

17. A terminal block as set forth in claim 16 wherein said other of said parts of said terminal block has an opening therethrough that defines two facing and spaced apart surface means, said two surface means comprising said stop means, said reed switch means having a longitudinal axis and being carried by said one of said parts of said terminal block so that said axis thereof is generally parallel to said surface means.

18. A terminal block as set forth in claim 14 wherein said two parts of said terminal block respectively have facing surfaces disposed in sliding relation and having spline means splining said surfaces together so as to limit the sliding movement therebetween.

* * * * *